US006439623B1

(12) United States Patent
Lohfeld et al.

(10) Patent No.: US 6,439,623 B1
(45) Date of Patent: Aug. 27, 2002

(54) DOOR LOCK OF A MOTOR VEHICLE OR THE LIKE WITH AN ELECTRIC LOCKING AID AND OPENING AID

(75) Inventors: Ulrike Lohfeld, Erkrath; Bernd Weyerstall, Wuppertal; Bernardo Erices, Berg.-Gladbach, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/646,130

(22) PCT Filed: Feb. 3, 2000

(86) PCT No.: PCT/DE00/00335

§ 371 (c)(1),
(2), (4) Date: Dec. 6, 2000

(87) PCT Pub. No.: WO00/46472

PCT Pub. Date: Aug. 10, 2000

(30) Foreign Application Priority Data

Feb. 4, 1999 (DE) ..... 199 04 663

(51) Int. Cl.[7] ..... E05C 3/16

(52) U.S. Cl. ..... 292/201; 292/216; 292/DIG. 23; 292/DIG. 43; 292/DIG. 65

(58) Field of Search ..... 292/201, 292, 292/216, DIG. 23, DIG. 43, DIG. 65

(56) References Cited

U.S. PATENT DOCUMENTS

| | | | | | |
|---|---|---|---|---|---|
| 5,603,537 | A | * | 2/1997 | Amano et al. | 292/201 |
| 5,697,237 | A | * | 12/1997 | Dilger et al. | 70/264 |
| 5,762,384 | A | * | 6/1998 | Bartel | 292/216 |
| 5,802,894 | A | * | 9/1998 | Jahrsetz et al. | 70/264 |
| 5,934,717 | A | * | 8/1999 | Wirths et al. | 292/201 |
| 5,938,253 | A | * | 8/1999 | Szablewski et al. | 292/216 |
| 5,992,194 | A | * | 11/1999 | Baukholt et al. | 70/279.1 |
| 6,067,826 | A | * | 5/2000 | Holloway et al. | 70/278.3 |
| 6,076,868 | A | * | 6/2000 | Roger, Jr. et al. | 292/201 |
| 6,148,651 | A | * | 11/2000 | Roncin | 70/264 |
| 6,223,468 | B1 | * | 5/2001 | Kobayashi | 49/280 |
| 6,279,361 | B1 | * | 8/2001 | Baukholt et al. | 70/279.1 |
| 2001/0010427 | A1 | * | 8/2001 | Roos | 292/201 |

FOREIGN PATENT DOCUMENTS

| | | |
|---|---|---|
| DE | 29 49 319 | 10/1980 |
| DE | 32 07 880 | 9/1983 |
| DE | 32 42 527 | 5/1984 |
| DE | 38 36 771 | 1/1990 |
| DE | 196 50 661 | 6/1998 |
| DE | 197 14 992 | 9/1998 |
| EP | 0 496 736 | 9/1990 |

* cited by examiner

*Primary Examiner*—J. J. Swann
*Assistant Examiner*—Matthew E. Rodgers
(74) *Attorney, Agent, or Firm*—Nixon Peabody LLP; David S. Safran

(57) ABSTRACT

The subject matter of the invention is a motor vehicle door lock or the like with a lock latch (2) and a detent pawl which keeps the lock latch in the main catch and the preliminary catch, with an electrical auxiliary closing drive (5) which is turned on after the lock latch (2) has reached a preclosing position and then transfers the lock latch (2) by motor into the main closing position, and with an electric auxiliary opening drive (10) which is turned on to raise the detent pawl (3) off the main catch or the preliminary catch of the lock latch (2). This door lock is characterized in that the coupling of the auxiliary closing drive (5) has a mechanical coupling element **(9*a*) which can be raised for decoupling and which can be raised by a correspondingly controlled actuation of the electrical auxiliary opening drive (10). One version is especially important in which power supply to the electrical auxiliary opening drive (10) takes place via the extra battery (17) which is always recharged from the vehicle electrical system (15) (active electrical redundancy), but power supply of the electrical auxiliary closing drive (5) takes place directly from the vehicle electrical system (15)**.

15 Claims, 6 Drawing Sheets

DOOR LOCK OF A MOTOR VEHICLE OR THE LIKE WITH AN ELECTRIC LOCKING AID AND OPENING AID

The invention relates to a motor vehicle door lock or the like, mainly a motor vehicle side door lock, optionally also a motor vehicle rear door lock, rear hatch lock or hood lock, with the features of the preamble of claim 1.

Motor vehicle door locks with auxiliary closing drives have been known for a long time and in the meantime have become common in mid-range vehicles. In particular worm wheel drives are popularly used because they have especially small dimensions. Ordinarily the drive element of the auxiliary closing drive is coupled to the lock latch such that the lock latch can run freely in the pulling direction. This takes into account the fact that vigorous slamming of the motor vehicle door is designed to be able to entrain the lock latch in advance of the drive element.

Normally, in a motorized, especially electric-motorized auxiliary closing drive it is turned on after the lock latch has first reached a preclosing position. The preclosing position is generally the preliminary catch or a position slightly behind the preliminary catch in the pulling direction (overstroke). From there then the lock latch is transferred likewise by motor into the main closing position, generally the main catch on the lock latch. Moving the lock latch by means of the corresponding drive element of the auxiliary closing drive into the main closing position is associated with the problem that when the drive element is stationary in front of the corresponding force transfer surface of the lock latch, the motor vehicle door can be blocked. Even in the closing process itself, therefore when the motor vehicle door is being pulled by means of the auxiliary closing drive, emergency situations can arise, for example, the extremities or articles of clothing can be caught. The approach in the prior art uses mechanical, key-actuated emergency trigger elements (EP-B-0 496 736) or coupling levers which can be raised manually from the outside opening handle (DE-A-38 36 771).

In the known motor vehicle door lock or the like which underlies the invention (DE-A-197 14 992) there is a decoupling possibility for the auxiliary closing drive which is suitable for emergency purposes and which does not require mechanical action into the lock mechanism from the outside. To do this, in this motor vehicle door lock an electromagnetic clutch is integrated into the step-down gear and it can couple the electric drive motor to the drive element and decouple it therefrom. Even when the electric drive motor is running the meshed electromagnetic clutch can be decoupled depending on a triggering criterion. The preferred triggering criterion is pulling on the outside opening handle (on the inside opening handle), which triggers an electrical switching process which leads to decoupling of the electromagnetic clutch. This corresponds to the intuitive action which arises in purely mechanical motor vehicle door locks in order to open the door quickly again when a coat becomes caught when pulling the motor vehicle door closed.

In the aforementioned prior art (DE-A-197 14 992) it is furthermore explained that as alternatives there could be motor shutoff or reversal of the direction of rotation of the electric drive motor of the auxiliary closing drive based on the triggering criterion.

Reference should be made to DE-A-197 14 992 for the further prior art on this subject and embodiments of the corresponding auxiliary closing drives.

The above explained motor vehicle door lock or the like which forms the starting point for the teaching of the invention is otherwise an electric lock of the modem design in which there is also an electric auxiliary opening drive which is turned on to raise the detent pawl off the main catch or the preliminary catch of the lock latch for purposes of opening the door. The triggering criterion here is likewise pulling on the inside opening handle or on the outside opening handle with the motor vehicle door lock or the like released. In this way the electrical auxiliary opening aid drive is triggered and it then acts on the detent pawl such that the latter is raised. In principle detailed approaches have been known for a long time, among others from DE-A-29 49 319 and DE-A-32 42 527.

For a pure electric lock, therefore a motor vehicle door lock or the like with an electrical auxiliary opening drive, the question of "redundancy" for an emergency is always important. In many embodiments mechanical redundancies are used. Then the detent pawl in addition to being raised by means of the auxiliary opening drive can also be raised mechanically, for example by a closing cylinder (EP-B-0 496 736). But here too a purely electrically redundant system is already known (DE-A-29 49 319) which is characterized in that in addition to the main battery of the vehicle electrical system, there is an extra battery. The safety-relevant systems and thus especially the electrical auxiliary opening drive of the motor vehicle door lock are supplied from the extra battery as the primary energy source. The extra battery is recharged in a suitable manner simply from the main battery of the vehicle electrical system. Discharging of the extra battery for the safety-relevant systems back into the main battery of the vehicle electrical system is prevented by circuity. This system ensures that even when the power of the vehicle electrical system fails for example after an accident (rupture of cable connections, etc.) the safety-relevant systems which are supplied from the extra battery continue to function. Of course the extra battery as an active element must be continually monitored for its charging state.

The teaching of this invention is to optimize an electrical motor vehicle door lock or the like with an electrical closing aid and electrical opening aid in terms of construction and safety engineering.

The aforementioned object is achieved in a motor vehicle door lock or the like with the features of the preamble of claim 1 by the features of the characterizing part of claim 1. Advantageous embodiments and developments are the subject matter of the dependent claims.

As claimed in the invention, the additional electrical component which are necessary in the purely electrically driven motor vehicle door lock which forms the starting point, specifically the electromagnetic clutch in the drive train of the auxiliary closing drive, is replaced by a mechanical coupling element which can be raised for decoupling. Its actuation takes place using the electrical auxiliary opening drive which is present anyway and which is triggered in one version of actuation such that it lifts this coupling element of the auxiliary closing drive. The previously separate systems, the auxiliary closing drive on the one hand and the opening aid on the other, are therefore linked to one another here by control engineering such that the electrical auxiliary opening drive intervenes into the train of force transfer of the auxiliary closing drive as the emergency actuation. Thus the electrical and circuitry prerequisites in a purely electrically driven motor vehicle door lock or the like are optimally used.

The teaching of the invention becomes especially important in the implementation of active electrical redundancy with an extra battery, as is known from the wider prior art.

Here optimization according to the teaching of the invention is achieved by the power supply of the electrical auxiliary closing drive being accomplished not via the recharged extra battery, but directly from the vehicle electrical system. This approach as claimed in the invention takes into account that it is not a good idea to route the considerable current consumed by the auxiliary closing drive via the extra battery. It can easily be drawn directly from the vehicle electrical system without endangering safety. When the vehicle electrical system fails the auxiliary closing drive does not work, but this is only an inconvenience, not a safety hazard. Conversely, the power supply of the auxiliary opening drive which also continues to perform the emergency function for the auxiliary closing drive remains optimum in terms of safety engineering.

In the following the invention is detailed using drawings which show simply one embodiment.

FIG. 1 schematically shows a first embodiment of a motor vehicle door lock or the like as claimed in the invention, shown using a side lock;

Figure 2:
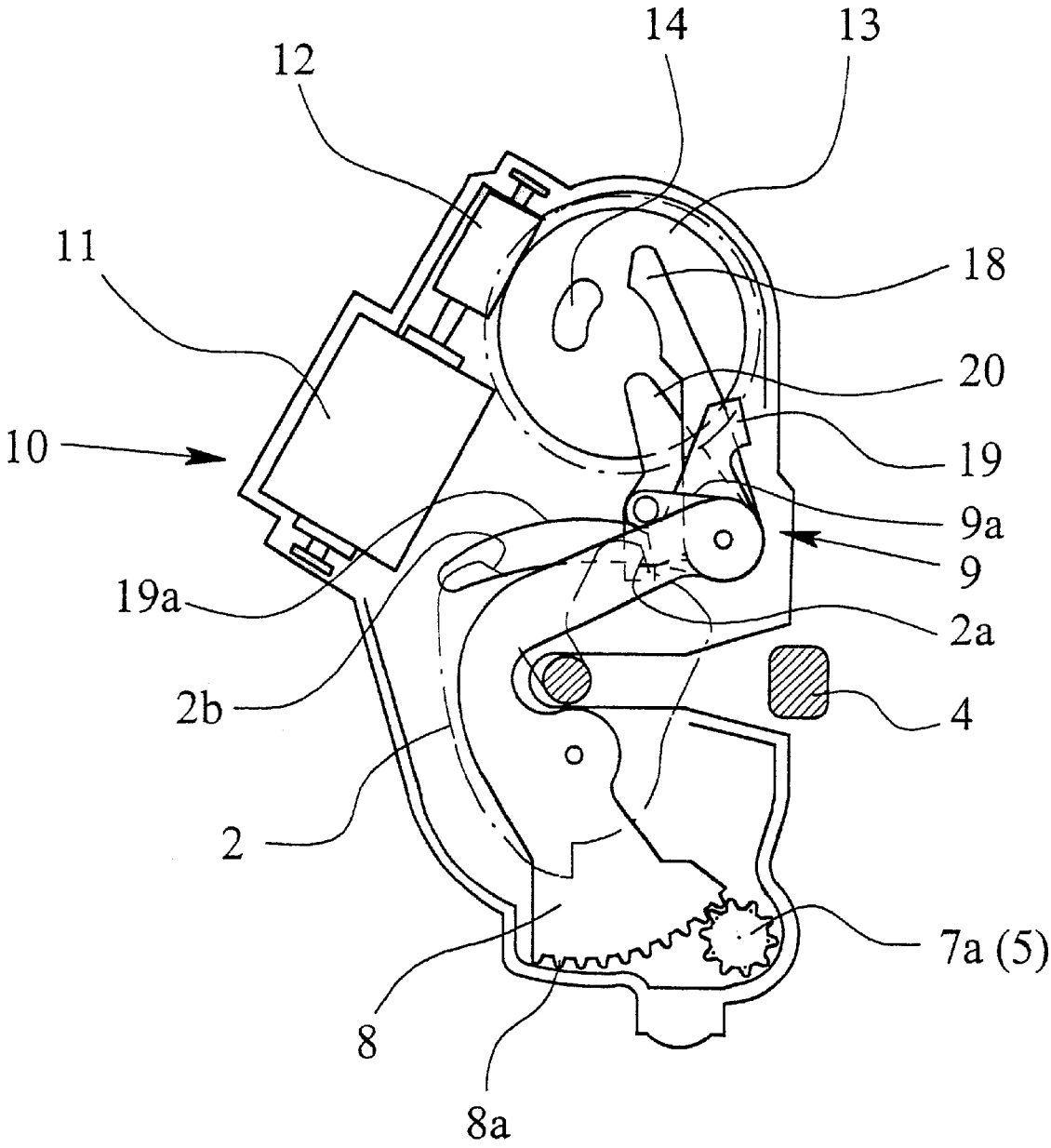
FIG. 2 shows the motor vehicle door lock from FIG. 1 in a schematic representation, view from the left, opened, the auxiliary closing drive itself omitted, all working parts in the neutral position with the motor vehicle door closed.
Figure 4:
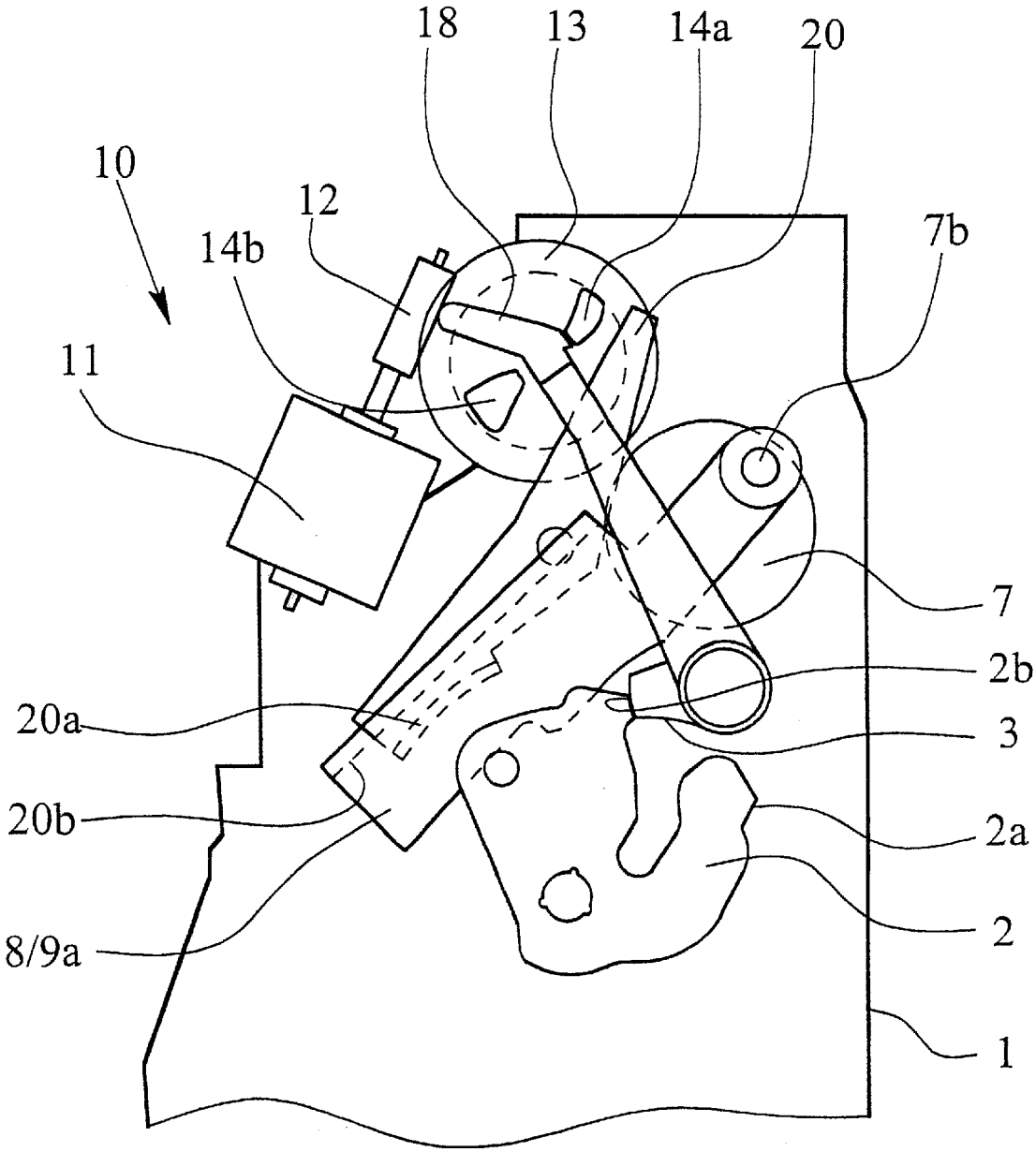
Figure 5:
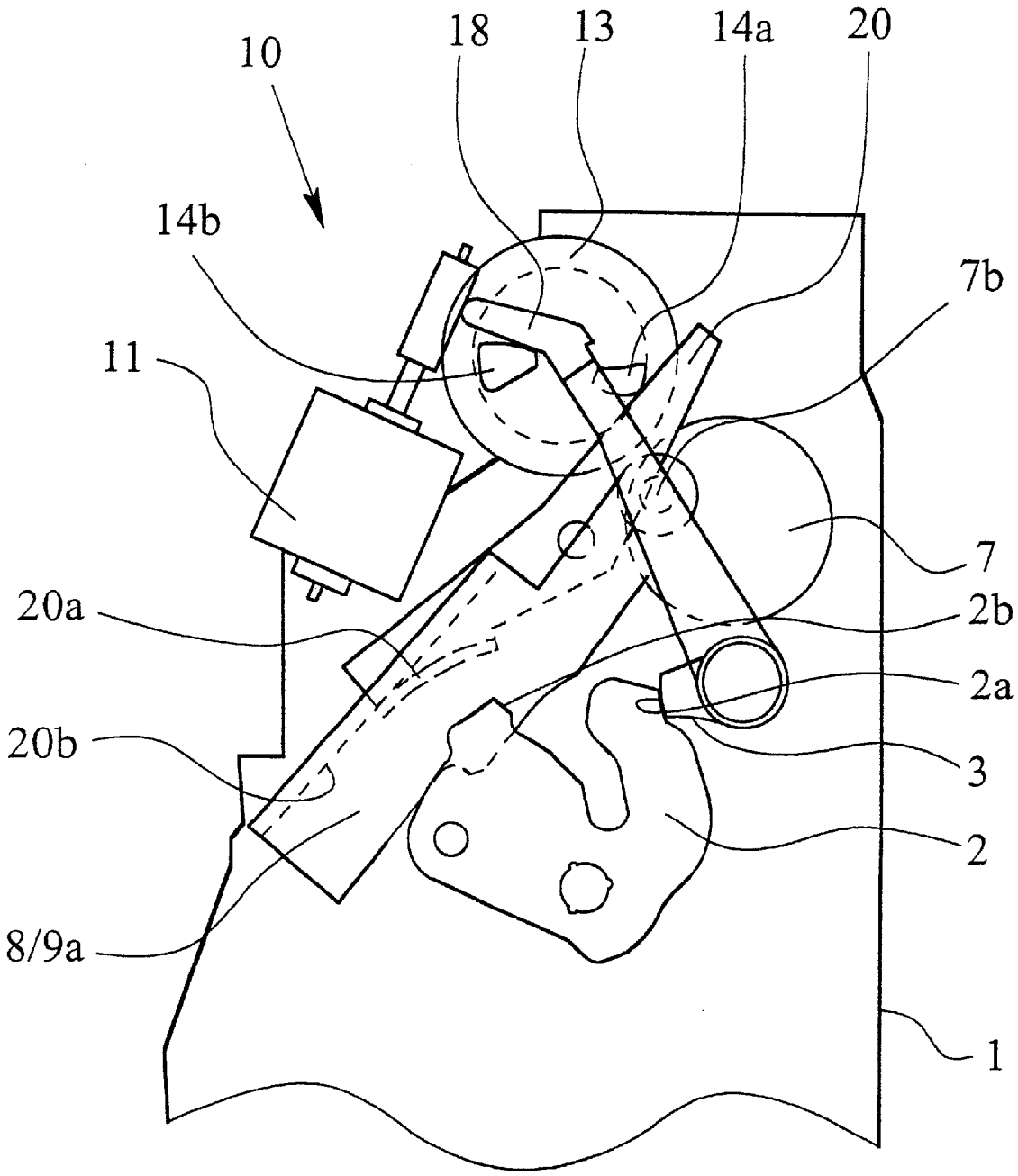
Figure 6:
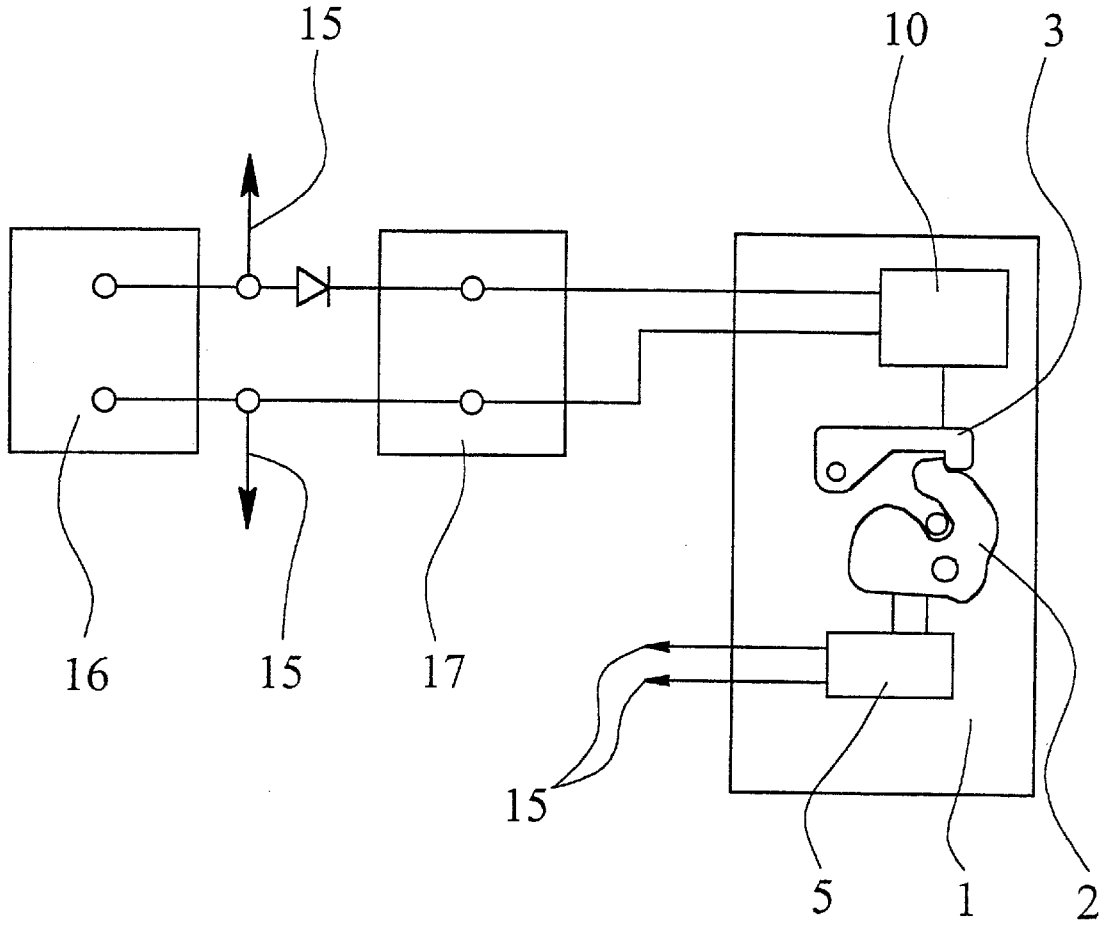

FIG. 4 shows in a representation similar to FIG. 2 another embodiment of a motor vehicle door lock or the like as claimed in the invention, in turn shown as the side door lock, all working parts in the preliminary catch position, FIG. 5 shows the motor vehicle door lock or the like from FIG. 4 in a corresponding representation, the coupling element of the auxiliary closing drive raised, FIG. 6 shows in a schematic representation a circuit diagram for connection of the electric drives of the motor vehicle door lock or the like to the vehicle electrical system.

The drawings schematically show a motor vehicle door lock or the like in the form of a motor vehicle side door lock; the expansions which have been explained in the general part of the specification apply.

Figure 1:
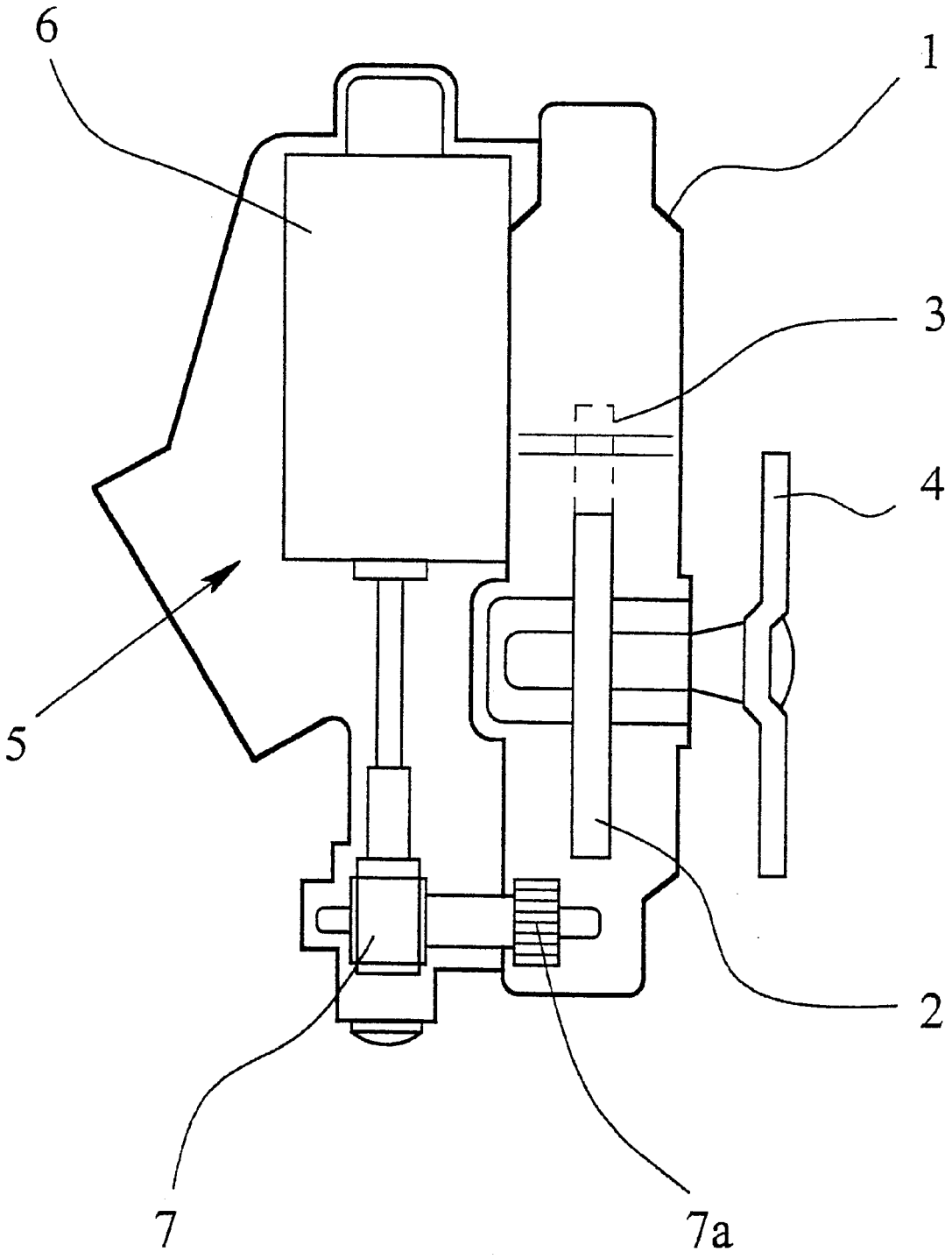

FIG. 1 first of all shows the motor vehicle door lock with a housing I and a lock latch 2 which is shown schematically therein, generally in the form of a fork rotary latch. A detent pawl 3 which holds the lock latch 2 in the main catch 2*a* and a preliminary catch 2*b* is shown in broken lines in FIG. 1. The main catch 2*a* and the preliminary catch 2*b* are shown in FIG. 2; in any case the compressively stressed detent pawl 3 cannot be seen there since it is hidden by the components located over it in planes. A corresponding compressively stressed detent pawl can however be easily seen in FIG. 4, for example.

Furthermore, a key collar 4 is drawn in the figures, here its being a key collar 4 made as a closing clip. Other key collars 4 in the form of closing pins, etc. are of course also known and can be used.

FIG. 1 shows the electrical auxiliary closing drive 5 of this motor vehicle door lock or the like which is turned on after the lock latch 2 has reached a preclosing position (explained in the general part of the specification). When the auxiliary closing drive 5 has been turned on, the auxiliary closing drive 5 transfers the lock latch 2 by motor to the main closing position shown in FIG. 2. The preclosing position can be the reaching of the preliminary catch 2*b* or reaching a certain position of the motor vehicle door relative to the body, for example with a residual gap of 6 mm. By means of the motorized closing aid the lock latch 2 is then easily transferred into the main closing position.

The auxiliary closing drive 5 generally has an electric drive motor 6 and step-down gear 7 which on the driven side is coupled to a drive element 8 on the lock latch 2. In this embodiment the drive element 8 is an arc-shaped lever with a sector gear 8*a* on the lower edge, which a pinion 7*a* of the step-down gear 7 engages.

A coupling 9 towards the lock latch 2 can selectively be electrically decoupled. In this embodiment the coupling 9 has a mechanical coupling element 9*a* which can be raised for decoupling.

Figure 3:
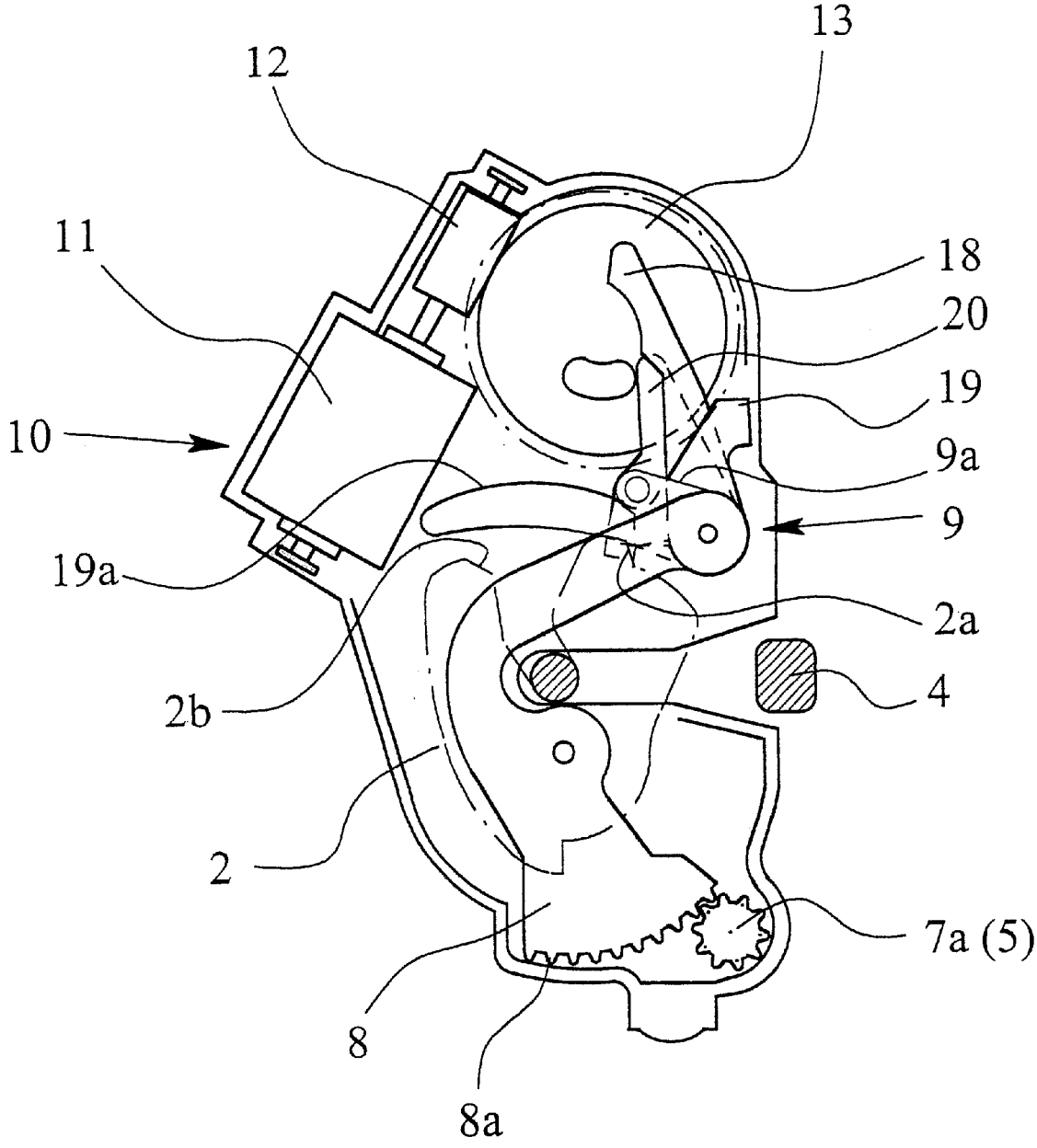
FIG. 3 shows in a representation corresponding to FIG. 2 the motor vehicle door lock or the like with the coupling element of the auxiliary closing drive raised.

In the embodiment shown in FIGS. 2 and 3 the lock latch 2 on the preliminary catch 2*b* has twice the width. On the preliminary catch 2*b* therefore both the detent pawl 3 and also the coupling element 9*a* of the coupling 9 of the auxiliary closing drive 5, i.e. the coupling element which lies over it in the plane, re-engage. FIG. 2 shows the main closing position—main catch 2*a*—with the auxiliary closing drive 5 returned to the initial position and the coupling element 9*a* which is inactive at the time. In this main closed position shown in FIG. 2 the lock latch 2 is held solely by the detent pawl 3 in the main catch 2*a*.

Furthermore, FIGS. 2 and 3 show an electrical auxiliary opening drive 10 which is turned on to lift the detent pawl 3 off the main catch 2*a* or the preliminary catch 2*b* of the lock latch 2, therefore to cause opening of the motor vehicle door lock or the like and thus the motor vehicle door. The auxiliary opening drive 10 also has an electric drive motor 11 and a step-down gear 12. The embodiment shown illustrates in this respect one preferred embodiment for the step-down gear 12 without this to be understood as limiting. The step-down gear 12 is made as a worm gear pair with a worm which is driven by the drive motor 11 and a worm wheel 13 which is coupled to (engages) this worm with the driving journal 14 located thereon. Conversely, in this embodiment the auxiliary closing drive 5 is equipped with an angular gear as the step-down gear 7, nor is this to be understood as limiting. The auxiliary closing drive 5 could also in principle be made as a worm gear pair, in any case it could also operate with a cam instead of a pinion as the force transfer element.

At this point it is of interest that the coupling element 9*a* of the coupling 9 of the auxiliary closing drive 5 can be lifted by correspondingly controlled activation of the electrical auxiliary opening drive 10. It is important that therefore the auxiliary opening drive 10 can lift not only the detent pawl 3, but with correspondingly different control the coupling element 9*a* of the coupling 9 of the auxiliary closing drive 5. The electric drive motor 11 of the auxiliary opening drive 10 therefore also acts into the force transfer train of the auxiliary closing drive 5. In this way, in spite of the lack of any mechanical emergency actuation elements an additional electrical component such as the aforementioned electromagnetic clutch in the step-down gear 7 of the auxiliary closing drive 5 can be saved.

The aforementioned concept acquires special importance when power supply to the electrical auxiliary opening drive 10 takes place via the extra battery 17 which is always recharged from the vehicle electrical system 15 with the main battery 16 of the motor vehicle (active electrical redundancy). This is shown in FIG. 6. Then it is guaranteed that emergency actuation of the coupling 9 of the auxiliary closing drive 5 is ensured at any time. But in order to not overload the extra battery 17 it is furthermore provided that power supply to the electrical auxiliary closing drive 5 takes place directly from the vehicle electrical system 15, therefore not via the extra battery 17. The high power consumption of the auxiliary closing drive 5 is satisfied directly from the vehicle electrical system 15, when the vehicle electrical system 15 fails, for example in an accident, the auxiliary closing drive 5 does fail, but this is not critical because its function itself is not safety-relevant and because the safety-relevant component of this function, specifically emergency decoupling, takes place by means of the auxiliary opening drive 10 which is secured via the extra battery 17.

In particular it is now provided in the embodiment shown in FIGS. 2 and 3 that the coupling element 9*a* of the coupling 9 is an extra detent pawl which re-engages the preliminary catch 2*b* of the lock latch 2. It is pivotally supported in this embodiment on the drive element 8 which is made as an arc-shaped lever on the bearing site shown, the drive element 8 itself in this embodiment being supported on the same axis of rotation as the lock latch 2. By moving the involved components, in this concept there is no relative displacement to one another because even the swivel axis is the same. This is advantageous with respect to the force transmission conditions.

In the embodiment shown in FIGS. 2 and 3 the auxiliary closing drive 5 has a reversible drive motor 6. Controlled by the corresponding operating points, the drive motor 6 runs in one direction until the main closing position is reached, then it is reversed and runs back in the opposite direction into the neutral position. The neutral position is shown in FIG. 2.

Alternatively it could also be provided that the auxiliary closing drive 5 be equipped with a nonreversible drive motor 6. Then it would feasible to make the step-down gear 7 reversible, for example to use the cam which was explained further above as the drive element which can then pass through in order to reach the initial position again. This is of course impossible in the approach shown with the sector gear 8*a* and the pinion 7*a*.

With respect to the auxiliary opening drive 10 the first embodiment in FIGS. 1 to 3 shows a version in which there is a driven element 13 which can be moved in two opposite directions and which in this embodiment is formed by the worm wheel of the step-down gear 12. Upon movement in one direction of rotation, i.e. in FIGS. 2 and 3 the direction clockwise, the detent pawl 3 and the coupling element 9*a* are lifted by means of the driving journal 14 running against a detent pawl lever 18. When the driven element 13 moves in the other direction of rotation only the coupling element 9*a* of the auxiliary closing drive 5 is lifted. This differentiation has the advantage that in terms of circuitry different treatment of emergency decoupling of the auxiliary closing drive 5 takes place depending whether the motor vehicle door lock is located overall in the secured or released state (locked or unlocked).

In the secured state it will not be possible to open the motor vehicle door lock from the outside opening handle. This state already exists when with the locking system already secured a rear side door is still being slammed. If this door is pressed closed in this state and the auxiliary closing drive 5 is turned on after reaching the preclosing position, the lock latch 2 is pulled tight. If for the purposes of emergency decoupling the outside opening handle is pulled and a corresponding operating pulse is triggered (the corresponding can also be accomplished when pulling on the inside opening handle), the electric drive motor 11 of the auxiliary opening drive 10 is started and drives the worm wheel 13 counterclockwise. In this way the coupling element 9*a* of the auxiliary closing drive 5 is raised and the detent pawl 3 remains uninfluenced. The lock latch pawl 2 therefore falls back only as far as the preliminary catch 2*b*, there it is caught by the detent pawl 3. The door remains in the preliminary catch position and stays closed.

If corresponding handling takes place with the motor vehicle door lock released, pulling on the outside opening handle for purposes of emergency decoupling during the closing process leads to triggering of the electric drive motor 11 of the auxiliary opening drive 10 in the opposite direction of rotation. The worm wheel 13 is moved clockwise and not only is the coupling element 9*a* raised, but also the detent pawl 3 is also lifted. In this case therefore the motor vehicle door springs open.

The embodiment shown illustrates that to perform the above explained function on the one hand a detent pawl lever 18 with a free-running lever 19 which can be entrained by the detent pawl lever 18 only in one direction is assigned to the driven element 13, therefore the worm wheel, of the auxiliary opening drive 10, on the other hand a decoupling lever 20 for raising the coupling element 9*a* is assigned.

In this embodiment it is provided that the free-running lever 19 has a section 19*a* which keeps the coupling element 9*a* in the lifted position optionally over the entire path of movement in the closing process. This section 19*a* is made here as an arc-shaped crank or track.

FIG. 3 shows the position which is assumed for emergency decoupling with the motor vehicle door lock or the like secured. The driving journal 14 has been moved against the decoupling lever 20 by the electric drive motor 11 by turning of the worm wheel 13 counterclockwise and has swivelled it clockwise around a swiveling axis which is stationary on the housing 1 and which in the embodiment shown is arranged flush with the illustrated swivel axis of the coupling element 9*a* for the location of the drive element 8 which is shown. Here the decoupling lever 20 has entrained the free-running lever 19 which has lifted the coupling element 9*a* over the section 19*a* which is then raised. This lifting of the coupling element 9*a* takes place as a result of the arc-shaped path of the section 19*a* at any point on the arch-shaped path of motion of the drive element 8.

The detent pawl 3 and the detent pawl lever 18 have not been further activated in the above explained example which is shown in FIG. 3. The detent pawl 3 in this embodiment therefore fixes the lock latch 2 unchanged in the main catch 2*a*. Somewhere on the path between the preliminary catch 2*b* and the main catch 2*a* the detent pawl 3 would remain in action, therefore catch the lock latch 2 when falling back after emergency decoupling of the auxiliary closing drive 5 in the preliminary catch 2*b*.

The embodiment shown in FIGS. 4 and 5 shows another version in which specifically the auxiliary opening drive 10 has one driven element 13 (here also a worm wheel) which can be reset into its original position and which can be moved in only one direction of rotation and when moved in the actuation direction it first lifts the coupling element 9*a* and afterwards upon further motion the detent pawl 3. In this embodiment it is provided that on the one hand a detent pawl lever 18 with unilateral free-running coupled to the detent pawl 3 is assigned to the driven element 13 of the auxiliary opening drive 10, on the other hand a decoupling lever 20 is assigned, with which the coupling element 9*a* of the coupling 9 can be lifted. The coupling element 9*a* of the coupling 9 here coincides with the drive element 8, both together are made as the connecting rod of a crank mechanism on the output side of the step-down gear 7. Here the decoupling lever 20 has a section 20*a* which holds the coupling element 9*a* optionally on the entire path of motion in the closing process in the lifted position and which is made as an arc-shaped crank and interacts with a corresponding section 20*b* on the drive element 8/coupling element 9*a*.

FIG. 5 shows that on the driven element 13 of the auxiliary opening drive 10 there are two force transfer elements here in the form of driving journals 14*a,b*, each force transfer element 14*a, b* actuating one of the levers 18; 20. In FIG. 5 the driving journal 14*a* for the decoupling lever 20 has been moved clockwise by roughly 60° by rotation of the worm wheel 13 so far that the decoupling lever 20 has been swivelled clockwise and has pulled the coupling element 9*a*/driven element 8 up so far that it is free of the lock latch 2. Likewise the lock latch 2 is also held by the detent pawl 3 since the detent pawl lever 18 remains unchanged, as in FIG. 4. This is first of all therefore emergency decoupling.

For the case in which the motor vehicle door is in the secured state in term of circuitry, pulling for example on the outside opening handle leads only to this function, furthermore the driven element/worm wheel 13 is not turned. The detent pawl 3 remains re-engaged and would catch the lock latch 2 upon return to the preliminary catch 2*b*, as shown.

For the case of released state of the motor vehicle door lock the actuation process of the auxiliary opening drive 10 continues, the worm wheel/driven element 13 continues to turn clockwise. At this point the driving journal 14*b* makes contact with the detent pawl lever 18, swivels it clockwise and in doing so lifts the detent pawl 3. After shut-off, the auxiliary opening drive 10 returns to its initial position which is shown in FIG. 4.

The transition from FIG. 4 to FIG. 5 for the auxiliary closing drive 5 shows the movement of the drive element 8/coupling element 9*a* after reaching the preclosing position. The connecting rod which is attached to a cam 7*b* and which is at the same time the drive element 8 and the coupling element 9*a* which can be swivelled out, could, if it were not lifted, turn the lock latch 2 into the main closing position. Then the cam moves back into the initial position by continuing rotation by another 180°.

The circuit diagram from FIG. 6 has been explained above in conjunction with the explanation of the teaching of claim 2; no further remarks are necessary here.

What is claimed is:

1. Motor vehicle door lock comprising:

a lock latch having a main catch and a preliminary catch;

a detent pawl which keeps the lock latch in the main catch and in the preliminary catch postions;

an electrical closing drive including an electric motor which is actuated after the lock latch has reached a preclosing position wherein the detent pawl retains the lock latch in the preliminary catch position, and which then transfers the lock latch, utilizing the electric motor, into a main closing position with the detent pawl retaining the lock latch in the main catch position;

an electric opening drive which is adapted to raise the detent pawl of the main catch or to raise the preliminary catch of the lock latch;

wherein the electric motor of the electrical closing drive includes a step-down gear, which is coupled to a drive element on the lock latch by means of a coupling;

wherein the coupling, adjacent the lock latch, can be selectively electrically decoupled; and, wherein the coupling has a mechanical coupling element which is operable by the electric opening drive and can be raised, in an emergency situation, for decoupling by a correspondingly controlled actuation of the electric opening drive to interrupt the chain of force from the closing drive to the lock latch.

2. Motor vehicle door lock as set forth in claim 1, wherein power to the electrical opening drive is via an additional battery which is always recharged by a vehicle electrical system, wherein power to the electrical closing drive takes place directly from the vehicle electrical system.

3. Motor vehicle door lock as set forth in claim 1, wherein the coupling element is an extra detent pawl which re-engages the preliminary catch of the lock latch.

4. Motor vehicle door lock as set forth in claim 1, wherein the electric motor of the electrical closing drive is a reversible drive motor.

5. Motor vehicle door lock as set forth in claim 1, wherein the electric motor of the electrical closing drive is a non-reversible drive motor which is connected to a reversible step-down gear.

6. Motor vehicle door lock as set forth in claim 5, wherein the reversible step-down gear is a cam drive element.

7. Motor vehicle door lock as set forth in claim 1, wherein the electrical closing drive, after transfer of the lock latch into the main closing position or after interruption of the closing motion, returns to an initial position.

8. Motor vehicle door lock as set forth in claim 1, wherein the electrical opening drive includes a driven element which can be rotated in two opposite directions, wherein upon movement in one direction of rotation the driven element lifts the detent pawl and the coupling element and upon movement in the other direction of rotation the driven element lifts only the coupling element.

9. Motor vehicle door lock as set forth in claim 8, wherein the electrical opening drive further includes a detent pawl lever movable by the driven element and attached to a free-running lever which is movable by the detent pawl lever only in one direction.

10. Motor vehicle door lock as set forth in claim 9, wherein the coupling element includes a portion which is held by the free-running lever in the raised position and wherein the free-running lever has a section which keeps the coupling element in the lifted position throughout the closing process.

11. Motor vehicle door lock as set forth in claim 9, further including a decoupling lever wherein the decoupling lever is adapted to raise the coupling element while actuating the free-running lever without lifting the detent pawl or actuating the detent pawl lever.

12. Motor vehicle door lock as set forth in claim 1, wherein the electrical opening drive has one driven element which can be moved in one actuation direction of rotation, and which when moved in the actuation direction first lifts the coupling element and afterwards upon further movement in the actuation direction lifts the detent pawl and which can be reset into an original position after movement in the actuation direction.

13. Motor vehicle door lock as set forth in claim 12, wherein the driven element includes a detent pawl lever or a decoupling lever for raising the coupling element.

14. Motor vehicle door lock as set forth in claim 13, wherein the decoupling lever has a section which holds the coupling element in the lifted position along the path of motion of the decoupling lever and the coupling element has a section which is held in the lifted position by the decoupling element.

15. Motor vehicle door lock as set forth in claim 11, wherein the electrical opening drive includes a driven element comprising two force transfer elements in the form of projecting journals, a detent pawl lever, and a decoupling lever, wherein one force transfer element actuates the detent pawl lever to lift the detent pawl and the other force transfer element actuates the decoupling lever to lift the coupling element.

* * * * *